United States Patent [19]

Inoue

[11] 4,171,978

[45] Oct. 23, 1979

[54] IRON/CHROMIUM/COBALT-BASE SPINODAL DECOMPOSITION-TYPE MAGNETIC (HARD OR SEMI-HARD) ALLOY

[75] Inventor: Kiyoshi Inoue, Tokyo, Japan

[73] Assignee: Inoue-Japax Research Incorporated, Yokohama, Japan

[21] Appl. No.: 769,268

[22] Filed: Feb. 11, 1977

[30] Foreign Application Priority Data

Feb. 14, 1976 [JP] Japan ..... 51/15195

[51] Int. Cl.[2] ..... C22C 38/24; C22C 38/30

[52] U.S. Cl. ..... 75/126 E; 75/122; 75/126 H; 148/31.57

[58] Field of Search ..... 75/126 H, 126 E, 134 F, 75/122; 148/31.55, 31.57

[56] References Cited

U.S. PATENT DOCUMENTS

| | | | |
|---|---|---|---|
| 3,588,764 | 6/1971 | Olsen et al. | 75/126 H |
| 3,600,162 | 8/1971 | Kaplan et al. | 75/126 H |
| 3,806,336 | 4/1974 | Kaneko et al. | 75/122 |
| 3,954,519 | 5/1976 | Inoue | 148/31.57 |
| 3,986,867 | 10/1976 | Masumoto et al. | 75/126 H |
| 4,008,105 | 2/1977 | Yuda et al. | 148/31.57 |
| 4,093,477 | 6/1978 | Iwata et al. | 75/126 H |

FOREIGN PATENT DOCUMENTS

| | | | |
|---|---|---|---|
| 39-15522 | 8/1964 | Japan | 75/126 H |
| 42-19780 | 12/1967 | Japan | 75/126 H |
| 44-20683 | 11/1969 | Japan | 75/126 H |
| 50-101217 | 8/1975 | Japan | 75/126 H |
| 51-5612 | 2/1976 | Japan | 75/126 H |

*Primary Examiner*—Arthur J. Steiner
*Attorney, Agent, or Firm*—Karl F. Ross

[57] ABSTRACT

A spinodal decomposition type magnetic alloy which contains, in addition to 3 to 30% by weight cobalt, 10 to 40% by weight chromium, and iron, a quantity of 0.1 to 15% by weight vanadium, preferably 0.5 to 10% by weight vanadium. A body made from this alloy has excellent magnetic properties and excellent cold workability.

6 Claims, 5 Drawing Figures

IRON/CHROMIUM/COBALT-BASE SPINODAL DECOMPOSITION-TYPE MAGNETIC (HARD OR SEMI-HARD) ALLOY

FIELD OF THE INVENTION

This invention relates to an IRON/CHROMIUM/-COBALT-BASE SPINODAL DECOMPOSITION-TYPE MAGNETIC (HARD OR SEMI-HARD) ALLOY and, more particularly, to an improved alloy system which makes possible the production of the magnetic alloy body in a simplified manner while imparting to the body an excellent magnetic performance comparable with or even better than those of the alloys of this type heretofore proposed.

BACKGROUND OF THE INVENTION

As pointed out in U.S. Pat. No. 3,806,336 issued Apr. 23, 1974, it is known that the iron/chromium alloy system has, in its composition diagram, a "limit of metastability" or "spinodal" which is thermodynamically defined as the locus of disappearance of the second derivative of the Helmholtz free energy with respect to the composition of the system. When a high-temperature composition, which is of homogeneous single phase structure ($\alpha$-phase), of the alloy is brought within the spinodal in a lower temperature range, it is transformed into a separated two-phase structure ($\alpha_1+\alpha_2$), the phase separation being called "spinodal decomposition". The decomposed alloy has a periodic microstructure generally of the order of hundreds of two angstroms and which consists of composition modulated isomorphous phases in which one phase ($\alpha_1$) is in the form of a fine precipitate uniformly distributed in another phase ($\alpha_2$) which forms the matrix. It is observed if the first phase in such a microstructure is magnetic and the second is nonmagnetic, there results a single-domain structure whereby a highly retentive magnetic body can be obtained.

Said U.S. patent discloses that the iron/chromium alloy of spinodal decomposition type, when it contains cobalt, optionally also with one or both of molybdenum and tungsten in the proportions set forth therein, represents an improved magnetic-material system whose magnetic retentivity and magnetic energy product are comparable with or generally even higher than, those of "Alnico" (iron/aluminum/nickel/cobalt) alloys which have hitherto been the mainstay of the magnetic industry. In addition to their excellent magnetic properties, the improved alloys have, because of their constituent metals, the advantages of lower material cost and better workability than the conventional alloys. It has also been taught that addition of silicon up to a certain proportion moderates heat-treatment conditions required to accomplish the spinodal decomposition of the alloys without materially decreasing the desirable magnetic properties attainable therewith. The art has also recognized that the addition of one or more of manganese, nickel, copper and aluminum in a small proportion may be advantageous.

As noted above, the desirable magnetic characteristics of the alloy are imparted when the high-temperature homogeneous single phase i.e. $\alpha$-phase, decomposes into the two isomorphous phases i.e. $\alpha_1$ and $\alpha_2$ phases, through the spinodal. Accordingly, the method of preparing a magnetic body of the improved alloy system essentially comprises the procedures required to effect the spinodal decomposition of the alloy of a preselected composition. The composition may be prepared by melting constituent metals or components together in a suitable furnace or crucible and then casting the melt to form ingots. while such ingots may, after machining to a suitable dimension, be subjected directly to the treatment procedures, it is possible to convert the alloyed ingot into a powder and then to compact and sinter the particles to a coherent body of a desired geometry. In order to effect the spinodal decomposition, while a gradual cooling may be employed to pass the alloy from the high-temperature phase through the miscibility gap area, the following steps have been found more practical and highly suitable. The initial step comprises the solution treatment which includes heating at an elevated temperature for a substantial period of time and subsequent quenching to bring the homogenized high-temperature $\alpha$ phase to room temperature. The quenched body is then tempered or aged whereby the spinodal decomposition to $\alpha_1$ and $\alpha_2$ phases is obtained. The solution treatment may be preceded by hot or cold working. The tempering is preferably done stepwise at different temperatures. The solution-treated body is preferably subjected to an isothermal treatment in a magnetic field prior to the final tempering treatment. Magnetic properties of the body are generally improved when a cold working step is used prior to the final quenching step and subsequent to a preliminary tempering step or the magnetic treatment step.

With the prior compositions, however, to accomplish the solution treatment successfully and thus to form the homogeneous single phase $\alpha$ and bring the same to room temperature or aging temperature requires heating to as high as 1300° C. and subsequent quenching at a cooling rate as high as 200° C./sec. Heating to such a high temperature is also required when hot working of the alloy ingot is to be done preparatory to the solution treatment. While, as taught in said U.S. patent, the quenching rate can be lowered substantially by having the alloy contain silicon in the range as specified, the high-temperature heating requirements have imposed great difficulties on the manufacturing process and left much to be desired on the economy of the product magnets.

In order to overcome these difficulties, efforts have been made to explore a further component or components effective to extend the domain of the homogeneous $\alpha$ phase of the alloy system thereby enabling the alloy to be solution-treated and hot-worked at a lower, more practical temperature than the conventional composition while retaining excellent magnetic properties and an improved cold-workability. Thus, for example, in U.S. Pat. No. 3,954,519 issued May 4, 1976, there has already been disclosed an improved spinodal decomposition type alloy of the class described which by weight consists of essentially 3 to 20% cobalt, 10 to 40% chromium, 0.2 to 5% one or both of niobium and tantalum, 0 to 5% aluminum and the balance iron. As taught therein, the addition of one or both of niobium and tantalum, preferably also with 0.2 to 5% aluminum is effective to extend the domain of the $\alpha$ phase while reducing the $\gamma$ phase of the alloy system, thus making it possible to accomplish the solution treatment at a temperature as low as 900° C. or even in the order of 650° C. depending upon the relative alloy compositions.

The above proposed alloy has, however, still drawbacks arising from the fact that it to be effective or for better results commonly requires the addition of aluminum besides niobium and/or tantalum. A melt of the alloy added with aluminum gives rise to handling difficulties for casting and tends to yield irregular products. Moreover, while the use of best process parameters and compositions has proved to allow the alloy to achieve the maximum energy product as high as $5.7\times10^6$ G·Oe (with cold working) and $4.7\times10^6$ G·Oe (without cold working). The magnetic performance typically attainable by procedures currently adoptable for a mass production purpose is limited to $4\times10^6$ G·Oe or less and cannot be said to be satisfactory.

OBJECTS OF THE INVENTION

It is, therefore, the principal object of the present invention to provide still an improved composition for an iron/chromium/cobalt-base spinodal decomposition type magnetic alloy whereby the afore-mentioned problems associated with the compositions proposed heretofore are overcome. A specific object of the invention is to provide an improved alloy of the class described and containing a novel component which is effective to extend the domain of the homogeneous $\alpha$ phase of the alloy system thereby enabling the alloy to be solution-treated and hot-worked at much a decreased temperature or to the extent that the solution-treatment can be effected at a desired temperature or that such step can even be dispensed with while achieving excellent magnetic properties and retaining an improved cold workability.

SUMMARY OF THE INVENTION

I have found that addition of vanadium is effective to extend the domain of $\alpha$ phase while diminishing the domain of $\gamma$ phase, of the iron/chromium/cobalt-base alloy system, to improve the magnetic properties and yet to retain a melt of the alloy under satisfactory conditions for casting.

There is thus provided, in accordance with this invention, an improved spinodal decomposition type alloy which by weight consists of essentially 3 to 30% cobalt, 10 to 40% chromium, 0.1 to 15% vanadium and the balance iron.

BRIEF DESCRIPTION OF THE DRAWING

The above and other objects, features and advantages of this invention will become more readily apparent from the following description, reference being made to the accompanying drawing in which.

SPECIFIC DESCRIPTION

Figure 1:
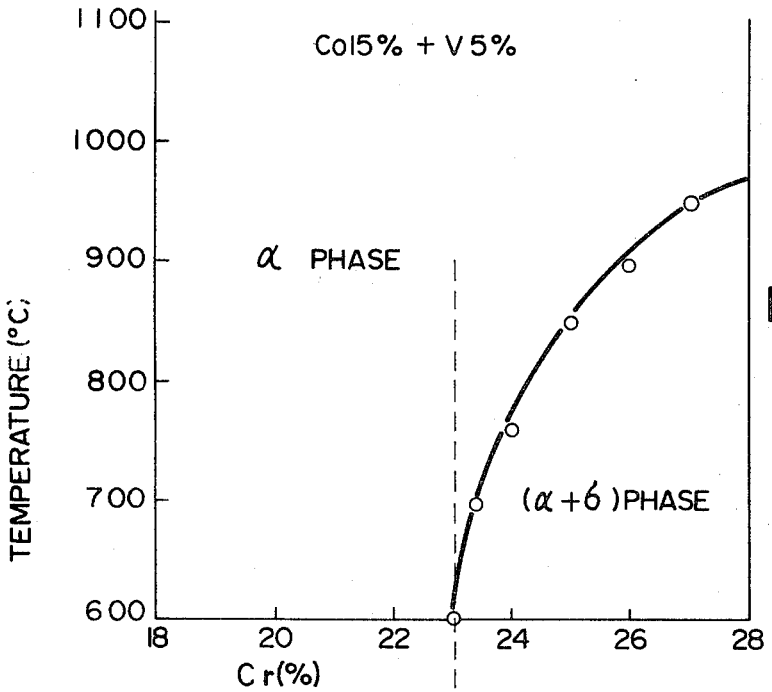
FIG. 1 is a cross-sectional phase diagram of a vanadium-containing iron/chromium/cobalt alloy with cobalt and vanadium proportions being fixed by weight at 15% and 5%, respectively, for illustration of this invention.

Referring now to FIG. 1 which illustrates the cross-sectional phase diagram of an Fe-Cr-15%Co-5%V alloy composition, it can be seen that a large domain of the homogeneous $\alpha$ phase exists. Thus, when, for example, the composition containing 23% by weight chromium (23%Cr-15%Co-5%V-57%Fe) is taken, it is seen that the single domain $\alpha$ phase extends from the high-temperature range to 600° C. This indicates that the solution treatment can be carried out substantially at any temperature higher than 600° C. (practically at any or higher temperature than 700° C. to 800° C. that is slightly above that spinodal decomposition temperature). With the composition containing 20% by weight Cr chosen, the diagram shows that there solely is in existence the single domain $\alpha$ phase extending from the high-temperature to low-temperature ranges, indicating that the cast alloy body may omit the solution treatment and, without undergoing it, can be directly brought to a subsequent production step required to receive hard or semihard magnetic characteristics as desired.

It is further noted that if chromium content is increased up to 28%, a heating temperature of about 1000° C. suffices. Although not shown, it has been found that if it is increased to 40%, a temperature of about 1100° C. is sufficient for the solution treatment.

Comparison with addition of niobium (and/or tantalum) with or without aluminum shows that a large extension of $\alpha$ phase takes place by addition of vanadium due to a greater recession of two domain ($\alpha+\gamma$) phase (not here shown) towards the lower chromium range than recession of two domain ($\alpha+\delta$) phase towards the higher chromium range that is the case with niobium.

Figure 3:
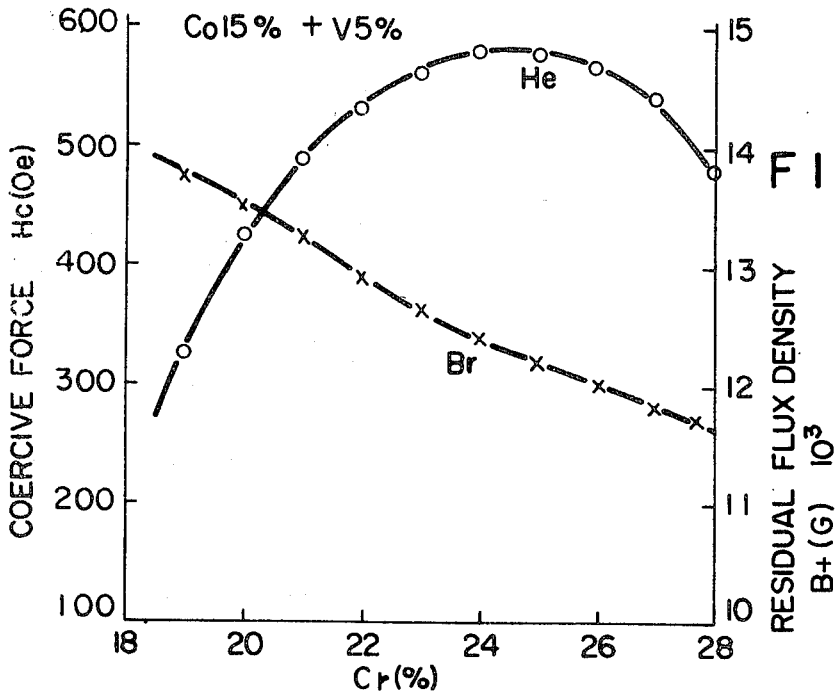

It should be noted at this point that when chromium content in the iron-chromium-cobalt alloy here concerned is increased to higher than 40%, the proportion of the non-magnetic phase markedly increases with the result of reduction of magnetic performance to an unacceptable extent due to the decrease of residual flux density as shown in FIG. 3 and also the alloy becomes excessively hard and brittle. For this reason, it is necessary to define the upper limit of chromium amount at 40% and, preferably 35% by weight.

Figure 4:
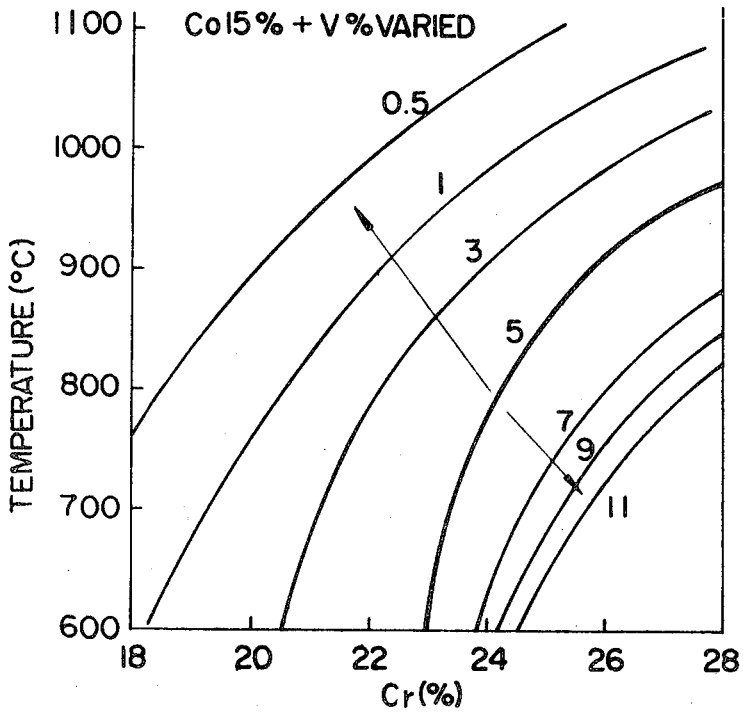
FIGS. 4 and 5 are characteristic phase diagrams obtained with vanadium and cobalt proportions of the alloy in the cross-sectional phase diagram of FIG. 1 varied with respect to fixed cobalt and vanadium proportions respectively.
Figure 5:
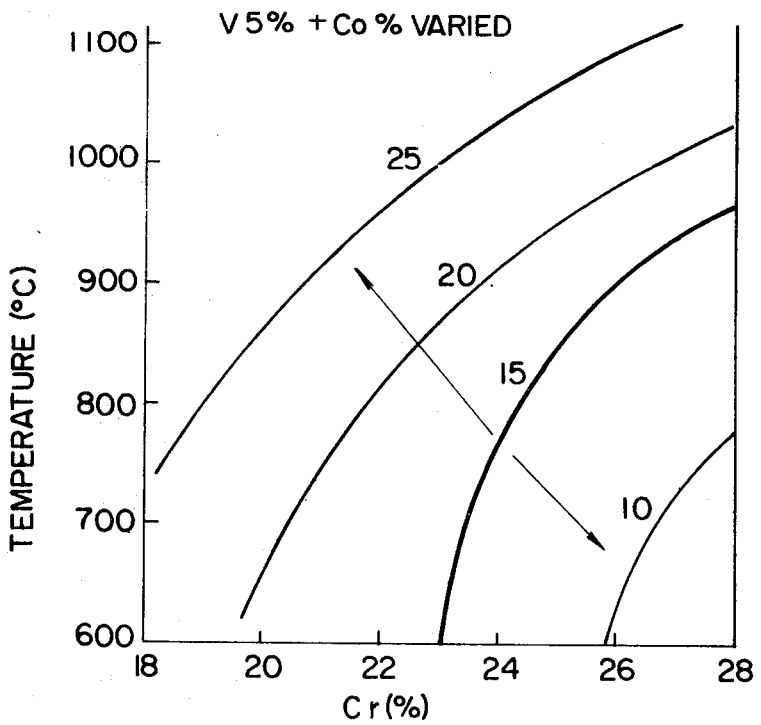

This is apparent also from FIG. 4 showing that the increase of the solution-treatment temperature due to higher chromium inclusion can be controlled by increasing the content of vanadium for a given cobalt content and from FIG. 5 showing that such increase of the solution-treatment temperature can also be controlled by decreasing the content of cobalt for a given vanadium content.

Figure 2:
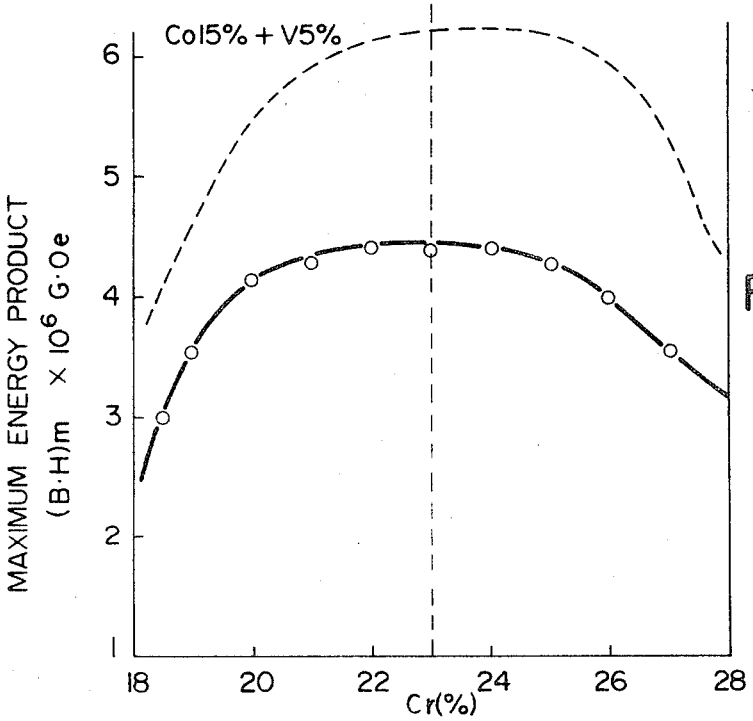
FIGS. 2 and 3 are graphs showing, respectively, the maximum energy product and the residual flux density plus the coercive force of the exemplary alloy composition of FIG. 1 according to the invention.

FIGS. 2 and 3 show that when the alloy has the chromium content reduced to about 19%, its maximum energy product (B·H)max drops sharply as does its coercive force (Hc). FIG. 5 shows that by increasing the content of cobalt, the range of chromium content in which good magnetic properties are obtained may extend sufficiently down to around 15%. The lower limit of chromium content is thus defined at 10% and preferably 15% by weight, at which the proportion of the non-magnetic phase which can be formed necessary to impart the desired coercive force to the alloy becomes insufficient and the solution treatment also becomes difficult.

The alloy hardly undergoes the spinodal decomposition and its attainable coercive force is sharply reduced when the cobalt content is less than 3%. Accordingly, the lower limit of cobalt is defined at 3% and preferably 5%. As noted from FIG. 5, the temperature required for solution treatment rises as the cobalt content is increased even with the chromium content decreased and with the vanadium additive incorporated. Since the solution temperature thus becomes difficult and the plastic workability also deteriorates when the cobalt content reaches 30%, its upper limits is defined at 30% and preferably 25% by weight.

As noted previously, the addition of vanadium is effective to enlarge the single $\alpha$-phase domain of the ternary Fe-Cr-Co alloy to an extent which has not been possible heretofore. Specifically, it is capable of bringing the lower Cr boundary of the single phase domain down to 15%. For comparison, reference is made to the earlier development of Fe-Cr-Co-Nb-Al noted hereinbefore in which the lowest Cr boundary possible is 23%. Thus, the v additive makes the solution treatment dispensable or insignificant over an extended range of the base alloy composition and, as a consequence, facilitates the heat treatment and also, if to be conducted, the hot working. Yet advantageously, it enables a melt of the alloy for casting to be held under good conditions, thus facilitating also the casting procedure; the alloy has an excellent cold workability.

The effective amount of vanadium to be incorporated into the base Fe-Cr-Co alloy in accordance with the invention lies between 0.1 and 15% by weight, its lower limit being preferably 0.5% by weight.

Thus, the improved magnetic alloy according to the invention has the following preferred composition 5 to 25% by weight Co, 15 to 35% by weight Cr, 0.5 to 10% by weight vanadium and the balance iron.

EXAMPLE

An alloy containing by weight 15% cobalt, 22% chromium, 5% vanadium and balance iron was prepared by melting an admixture of these ingredients in a high-frequency induction furnace in an argon atmosphere to form a cast body or ingot thereof. The ingot was hot or cold worked into a diameter of 10 mm. The solution treatment was carried out by heating the worked body at a temperature of 900° C. for 1 hour and then water-quenching it to a room temperature. This step, although omittable as noted previously, is desired owing to the fact that the casting step normally is not conclusive with quenching nor is it carried out with the final size and configuration of the product taken into consideration. Although 700° C. may be sufficient as is apparent from FIG. 1, the temperature of 900° C. was employed in consideration of fail-safe principle and extent of treatment time. The ingot was next tempered at 640° C. in a magnetic field of 4000 Oersted for 1 hour and then at 580° C. for 1 hour, fourth at 560° C. for 1 hour and finally at 540° C. for 5 hours. The resultant body had a residual flux density Br of 12700 Gauss, a coercive force Hc of 580 Oersted and a maximum energy product (B·H)max of $4.4\times10^6$ Gauss·Oersted.

When the content of chromium in the above alloy was varied, the phase diagram shown in FIG. 1 was obtained and the residual flux density, the coercive force and the maximum energy product were varied as shown in FIGS. 2 and 3.

Also, when the content of cobalt and the content of vanadium were each varied, the characteristics diagrams shown in FIGS. 4 and 5 were obtained and the values of the residual flux density, coercive force and maximum energy product shown in FIGS. 2 and 3 were found to each drop by 0 to 20%. From this, the composition 15%Co-22%Cr-5%V-58%Fe appears to be the best exhibiting optimal magnetic properties.

When, in the above process, a cold working step was introduced between the magnetic tempering and the step-tempering stages, the magnetic properties of the alloy were found to be enhanced markedly. Thus, a maximum energy product of $6.2\times10^6$ Gauss·Oersted was obtained when a working rate of 50 to 60% was employed. The values of maximum energy product obtained, varied with variation of chromium content, with the use of this cold working rate are plotted along the broken line in the diagram of FIG. 2.

The strength of the magnetic field, the temperature and the heating time in the magnetic tempering stage described above may be varied as from 2000 to 4000 Oersted, from 600° to 680° C. and from 10 minutes to 2 hours, respectively. The addition of vanadium was also found to permit the final step-tempering temperature to be reduced to 400° C.

It should be understood that the improved alloy in accordance with the invention, as described in the foregoing, does not exclude the addition of silicon which is effective to reduce the cooling rate in the quenching step or the addition of one or more of molybdenum tungsten, copper, nickel, titanium, niobium, tantalum and aluminum if desired, each of these optional known additives being referred to hereinbefore.

What is claimed is:

1. A spinodal decomposition type magnetic alloy consisting by weight essentially of 3 to 30% cobalt, 10 to 40% chromium, 0.1 to 15% vanadium and the balance iron and being capable of undergoing spinodal decomposition.

2. The alloy defined in claim 1 which contains 0.5 to 10% by weight vanadium.

3. The alloy defined in claim 1 which contains 5 to 25% by weight cobalt.

4. The alloy defined in claim 1 which contains 15 to 35% by weight chromium.

5. The alloy defined in claim 1 which contains 5 to 25% by weight cobalt and 15 to 35% by weight chromium.

6. The alloy defined in claim 5 which contains 0.5 to 10% vanadium.

* * * * *